US006209958B1

(12) United States Patent
Thole

(10) Patent No.: US 6,209,958 B1
(45) Date of Patent: Apr. 3, 2001

(54) UNIVERSAL TILT MECHANISM FOR A CHAIR

(75) Inventor: Douglas M. Thole, Grand Rapids, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/177,761

(22) Filed: Oct. 23, 1998

(51) Int. Cl.[7] ..... A47C 1/031

(52) U.S. Cl. ..... 297/302.1; 297/303.1; 297/325

(58) Field of Search ..... 297/302.5, 302.6, 297/300.1, 302.1, 303.1, 325

(56) References Cited

U.S. PATENT DOCUMENTS

| | | | |
|---|---|---|---|
| 9,620 | 3/1853 | TenEyck . | |
| 139,948 | 6/1873 | Doremus . | |
| 144,664 | 11/1873 | Doremus . | |
| 160,764 | 3/1875 | Gardner . | |
| 161,671 | 4/1875 | Doremus . | |
| 215,337 | 5/1879 | Doremus . | |
| 1,216,755 | 2/1917 | Whitten . | |
| 1,747,932 | 2/1930 | Dufaux . | |
| 2,056,965 | 10/1936 | Herold . | |
| 2,087,253 | 7/1937 | Herold . | |
| 2,184,988 | 12/1939 | Collier et al. . | |
| 2,228,719 | 1/1941 | Bolens . | |
| 2,353,737 | 7/1944 | Lorenz . | |
| 2,374,350 | 4/1945 | Herold . | |
| 2,410,871 | 11/1946 | Fields et al. . | |
| 2,779,390 | 1/1957 | Freeman . | |
| 2,787,315 | 4/1957 | Siebert . | |
| 2,796,920 | 6/1957 | Cowles . | |
| 2,799,323 | 7/1957 | Berg . | |
| 2,818,911 | 1/1958 | Syak . | |
| 3,220,688 | * 11/1965 | Baermann | 297/302.6 X |
| 3,284,133 | 11/1966 | Werner . | |
| 3,309,137 | 3/1967 | Wiebe . | |
| 3,544,159 | * 12/1970 | Andersson | 297/302.6 X |
| 3,672,721 | 6/1972 | Williams . | |
| 3,693,925 | 9/1972 | Weinstein . | |
| 3,740,792 | 6/1973 | Werner . | |
| 3,770,235 | 11/1973 | Klapproth et al. . | |
| 3,826,456 | 7/1974 | Tranter et al. . | |
| 3,863,982 | 2/1975 | Sandham . | |
| 4,027,843 | 6/1977 | Thompson . | |
| 4,077,596 | 3/1978 | Pinaire et al. . | |
| 4,235,471 | 11/1980 | Tengler . | |

(List continued on next page.)

FOREIGN PATENT DOCUMENTS

| | | |
|---|---|---|
| 2 022 525 | 11/1971 | (DE) . |
| 0 574 375 B1 | 12/1993 | (EP) . |
| 33 758 | 3/1929 | (FR) . |
| 1 324 451 | 7/1973 | (GB) . |

*Primary Examiner*—Peter M. Cuomo
*Assistant Examiner*—David E. Allred
(74) *Attorney, Agent, or Firm*—Flynn, Thiel, Boutell & Tanis, P.C.

(57) ABSTRACT

An office chair includes a tilt control mechanism which connects a seat assembly to a base. The tilt control mechanism defines a pivot connection between the seat assembly and the base whereby the seat assembly effectively pivots about a pivot point in any direction extending radially from the pivot point. The tilt control mechanism includes an annular elastomeric ring which resists multi-directional tilting and biases the seat assembly to a neutral position. The elastomeric ring is adjustable axially toward and away from the pivot point to adjust resistance to tilting.

24 Claims, 12 Drawing Sheets

U.S. PATENT DOCUMENTS

| | | |
|---|---|---|
| 4,372,606 | 2/1983 | Faull . |
| 4,455,010 | 6/1984 | Butler . |
| 4,597,567 | 7/1986 | Racca . |
| 4,640,548 | 2/1987 | Desanta . |
| 4,664,445 | 5/1987 | Groseth . |
| 4,752,101 | 6/1988 | Yurchenco et al. . |
| 4,852,943 | 8/1989 | Roper . |
| 4,871,208 | 10/1989 | Hodgdon . |
| 4,889,385 | 12/1989 | Chadwick et al. . |
| 4,890,886 | 1/1990 | Opsvik . |
| 4,995,598 | 2/1991 | Ingham . |
| 5,170,997 | 12/1992 | Girard et al. . |
| 5,288,127 | 2/1994 | Berg et al. . |
| 5,409,295 | 4/1995 | Edstrom . |
| 5,573,304 | 11/1996 | Glöckl . |
| 5,649,740 | 7/1997 | Hodgdon . |

* cited by examiner

UNIVERSAL TILT MECHANISM FOR A CHAIR

FIELD OF THE INVENTION

This invention relates to an office chair and, in particular, to an adjustable universal tilt mechanism which pivotally connects a seat assembly to a base.

BACKGROUND OF THE INVENTION

Conventional office chairs frequently include a seat-back arrangement which is connected to a base by a tilt mechanism. The tilt mechanism defines one or more pivot axes about which a seat or back assembly may pivot or tilt relative to the base. Office chairs typically tilt rearwardly about fixed horizontal pivot axes wherein the seat and back assemblies are rearwardly tiltable either together or independently. To resist such tilting and bias the seat and back assemblies to normal upright positions, numerous tilt mechanisms have been provided which include springs such as coil, leaf and torsion springs which oppose the tilting movement.

As an alternative to conventional spring arrangements, prior tilt control mechanisms have also used elastomeric pads or rings between relatively moving surfaces. The pads or rings are resilient so as to be compressed between the moving surfaces to resist the tilting movement. Some of these tilt mechanisms permit the seat to pivot in multiple directions.

Examples of chairs using elastomeric pads or rings which permit tilting in multiple directions are disclosed in U.S. Pat. Nos. 139,948, 3,309,137, 4,027,843, and 5,573,304. The 3,309,137 patent permits adjustment of tilting resistance by varying the compression of an elastomeric ring. The chairs disclosed in the remaining patents do not permit adjustment of the tilting resistance.

In another chair as disclosed in U.S. Pat. No. 4,890,886, the tilt control mechanism defines a fixed pivot axis between the seat assembly and the chair base. The tilt control mechanism further includes a plate secured to the seat assembly so as to move with the seat assembly relative to the base, and a second plate which is spaced apart from the first plate and remains stationary relative to the base. These opposing plates move relative to each other during tilting of the seat assembly, and elastomeric pads are provided between these relatively movable plates to resist tilting and bias the seat assembly to a neutral position. To adjust resistance to tilting, the elastomeric pads are movable relative to the pivot axis to thereby adjust the distance defined therebetween. In one embodiment, the pads are vertically movable.

However, users, such as office workers, who sit in such chairs typically move in all directions, such as sidewardly, forwardly and rearwardly when working. Conventional tilt control mechanisms having fixed axes, however, restrict such movement due to the fixed axes, and hence do not readily accommodate the usual movements of a user such as movement to the side.

To more readily accommodate the various movements of a user, the chair of the present invention accommodates movement of a user both forwardly and sidewardly and in fact permits the chair seat to swivel about a connection point so as to react to the user. In particular, to overcome the disadvantages of conventional chair designs which use fixed pivot axes, the chair of the present invention includes a tilt control mechanism which permits universal tilting or swiveling of the seat assembly relative to the base in substantially all horizontal directions. The seat assembly is not restrained by fixed pivot axes but instead effectively pivots about a pivot or connection point. Thus, the seat assembly can pivot forwardly and rearwardly, sidewardly and in any other horizontal direction extending radially away from the pivot point, and can also be swivelled about the connection point. Thus, as a user shifts and moves, the chair reacts to the user's movements while still providing sufficient resistance to the universal tilting movement to provide stability and control for the user.

The tilt control mechanism of the invention, in an embodiment thereof, includes a support member which extends upwardly from the pedestal of the base. The support member has a bearing at the top thereof which pivotally supports a pivot bracket mounted on the seat assembly. The cooperating bearing and pivot bracket effectively define a pivot point, rather than a fixed horizontal pivot axis, about which the seat assembly pivots or swivels such that the seat assembly pivots in substantially all radial directions extending away from the pivot point.

To provide resistance to such tilting while providing stability for the user, the tilt control mechanism in a preferred embodiment includes a cylindrical housing which is disposed in concentric and surrounding relationship to the support column wherein the housing is spaced radially outwardly from the support column to define an annular clearance space therebetween. An elastomeric doughnut-shaped ring is disposed within this annular clearance space whereby the ring is disposed concentric with the column and housing and extends radially therebetween. As the housing moves with the seat assembly relative to the column, the elastomeric material of the resilient ring is compressed and limits the tilting, and restores the seat assembly to the initial neutral position.

The tilt control arrangement also permits adjustment of the tilting resistance to accommodate various size users or working conditions. The tilt control mechanism includes an adjustment mechanism connected to the resilient ring which allows a user to selectively move the resilient ring toward and away from the pivot point, whereby the effective resistance to tilting is increased or decreased.

The adjustment mechanism in this embodiment includes a drive ring or cylinder having an inclined groove or track, and an intermediate connector which is slidably connected to the inclined groove. As the intermediate connector slides along the inclined groove during rotation of the drive ring, the intermediate connector moves vertically. The intermediate connector is connected to the resilient ring to move vertically therewith. The connection of the intermediate connector to the inclined groove translates rotational movement of the drive ring into vertical movement of the resilient ring to thereby adjust the position of the resilient ring relative to the pivot point. Since the resilient ring effectively applies a biasing force to the housing as the resilient ring is compressed, this vertical movement of the resilient ring adjusts the location at which the force of the resilient ring acts relative to the pivot axis.

This pivot or tilt control arrangement thereby permits tilting of the seat assembly in any direction which extends radially away from the pivot point. Further, the tilting resistance can be conveniently adjusted by a person seated in the chair.

Other objects and purposes of the invention, and variations thereof, will be apparent upon reading the following specification and inspecting the accompanying drawings.

Figure 1:
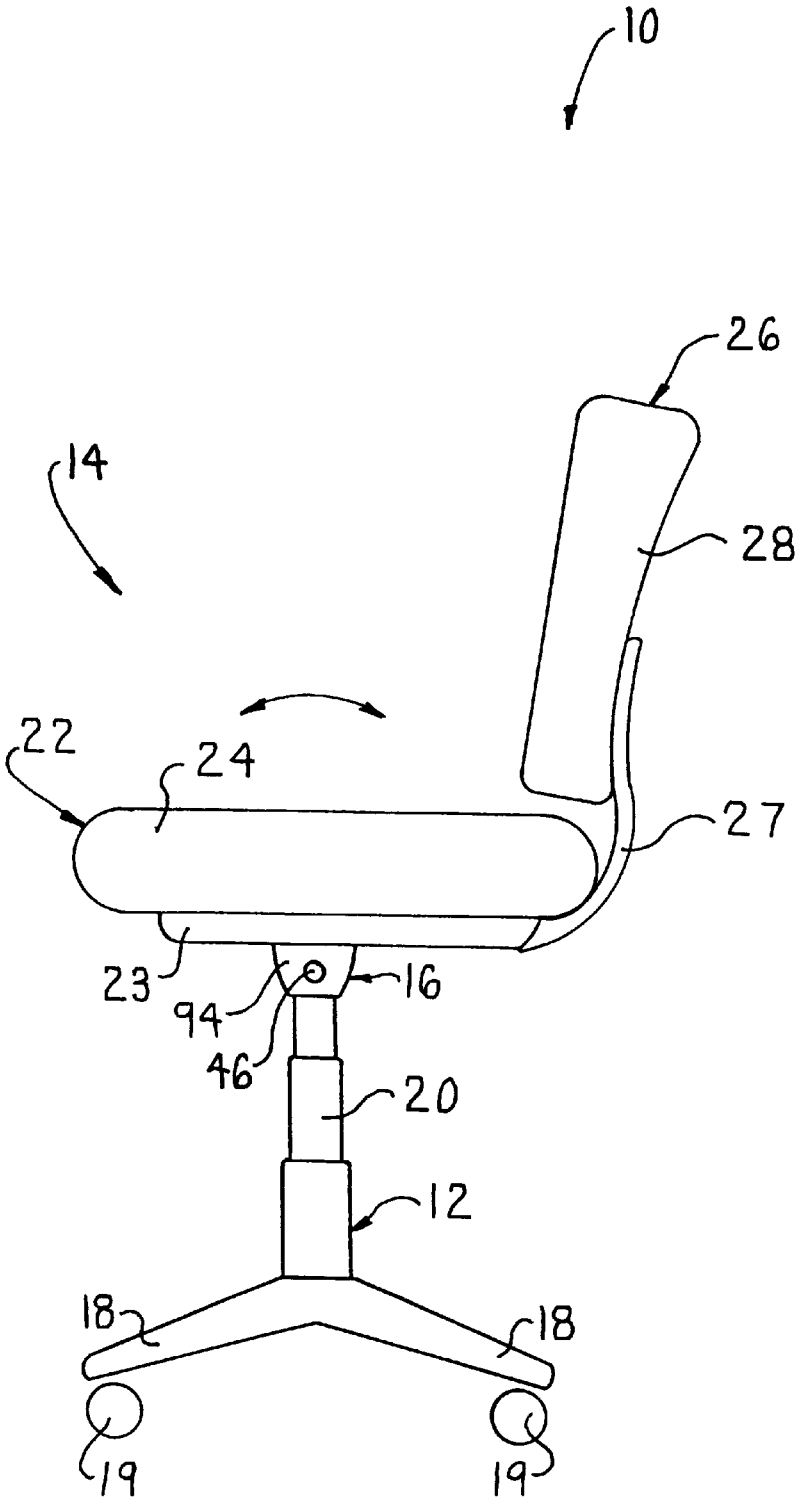
FIG. 1 is a side elevational view of a chair of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the chair 10 of the invention includes a base 12, a seat-back arrangement 14 and a tilt control mechanism 16 which connects the seat-back arrangement 14 to the base 12. The inventive tilt control mechanism 16 not only permits vertical tilting of the seat-back arrangement 14 relative to the base 12 in a forward-rearward direction but effectively in any horizontal direction (i.e. universally) as discussed herein.

The base 12 may be of a conventional construction and, in the illustrated embodiment, includes a plurality of radially extending legs 18 which are supported on a support surface by casters 19. The base 18 further includes a vertically elongate and cylindrical spindle or column 20 which projects upwardly from the legs 18 and supports the tilt control mechanism 16 on the upper end thereof.

The tilt control mechanism 16 also supports the seat-back arrangement 14. The seat-back arrangement 14 may be of any construction and in the illustrated embodiment includes a seat assembly 22 having a rigid housing 23 and a horizontally enlarged cushion 24 connected thereto.

The seat-back arrangement 14 also includes a back assembly 26 which is connected to the seat assembly 22 by a generally L-shaped rigid upright 27. The upright 27 has an upper end which supports a vertically enlarged back rest 28 thereon and a lower end which is connected to the seat housing 23.

The back assembly 26 and seat assembly 22 can be connected together in various conventional arrangements. For example, the lower end of the upright 27 may be rigidly fixed to the seat housing 23 such that the seat assembly 22 and back assembly 26 move together in unison. Alternatively, the lower end of the upright 27 may be pivotally connected to the seat housing 23 such that the back assembly 26 is vertically tiltable relative to the seat assembly 22 while the entire seat-back arrangement 14 is vertically tiltable relative to the base 12.

With respect to the tilt control mechanism 16, this mechanism connects the seat-back arrangement 14 to the base 12 to permit universal tilting or swiveling therebetween. While many conventional tilt control mechanisms define fixed pivot axes about which the seat or back are tiltable, the tilt control mechanism 16 of this invention not only permits tilting of the seat-back arrangement 14 forwardly and rearwardly, but also in any direction relative to a central upright axis defined by the base 12.

In particular, while the seat-back arrangement 14 is generally biased to the neutral position illustrated in FIG. 1, the tilt control mechanism 16 of the invention permits the seat assembly 22 to pivot and swivel about a pivot point so as to permit universal tilting of the seat assembly 22. Thus, the seat-back arrangement 14 reacts to movements of a user forwardly and rearwardly and also sidewardly and any direction therebetween.

The tilt control mechanism 16 (FIGS. 2 and 4) includes a pivot or support fitting 30 which is rigidly supported on the upper end of the spindle 20. To pivotally connect the seat assembly 22 to the spindle 20, a retainer bracket 31 is supported on the upper end of the support fitting 30 by a pivot connection defined therebetween. The retainer bracket 31 rigidly supports the seat assembly 22 thereon such that the seat assembly 22 is vertically pivotable relative to the base 12. As described herein, the pivot connection between the support fitting 30 and retainer bracket 31 effectively defines a pivot point 70 rather than a fixed pivot axis such that the seat assembly 22 is pivotable in any horizontal direction extending radially away from the pivot point.

The tilt control mechanism 16 also includes an elastomeric resilient ring 34 which resists tilting of the seat assembly 22. The resilient ring 34 is vertically movable to adjust the resistance to tilting, and the tilt control mechanism 16 further includes an adjustment mechanism 35 to adjust the position of the resilient ring 34 relative to the pivot point and thereby adjust the tilting resistance. The specific construction and function of these component parts is described in more detail hereinafter.

Figure 2:
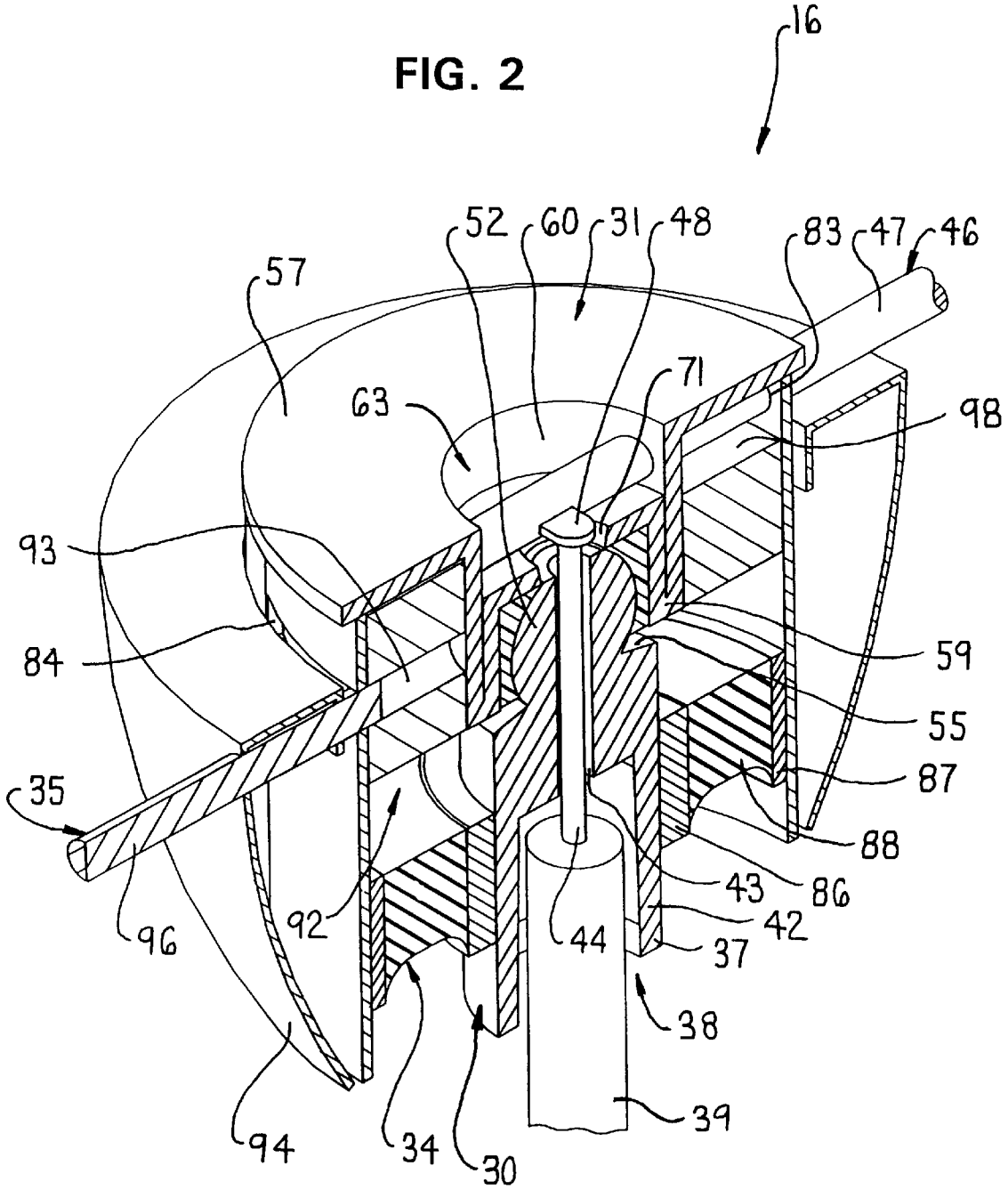
FIG. 2 is a partial perspective view in cross-section of a tilt control mechanism of the chair.
Figure 4:
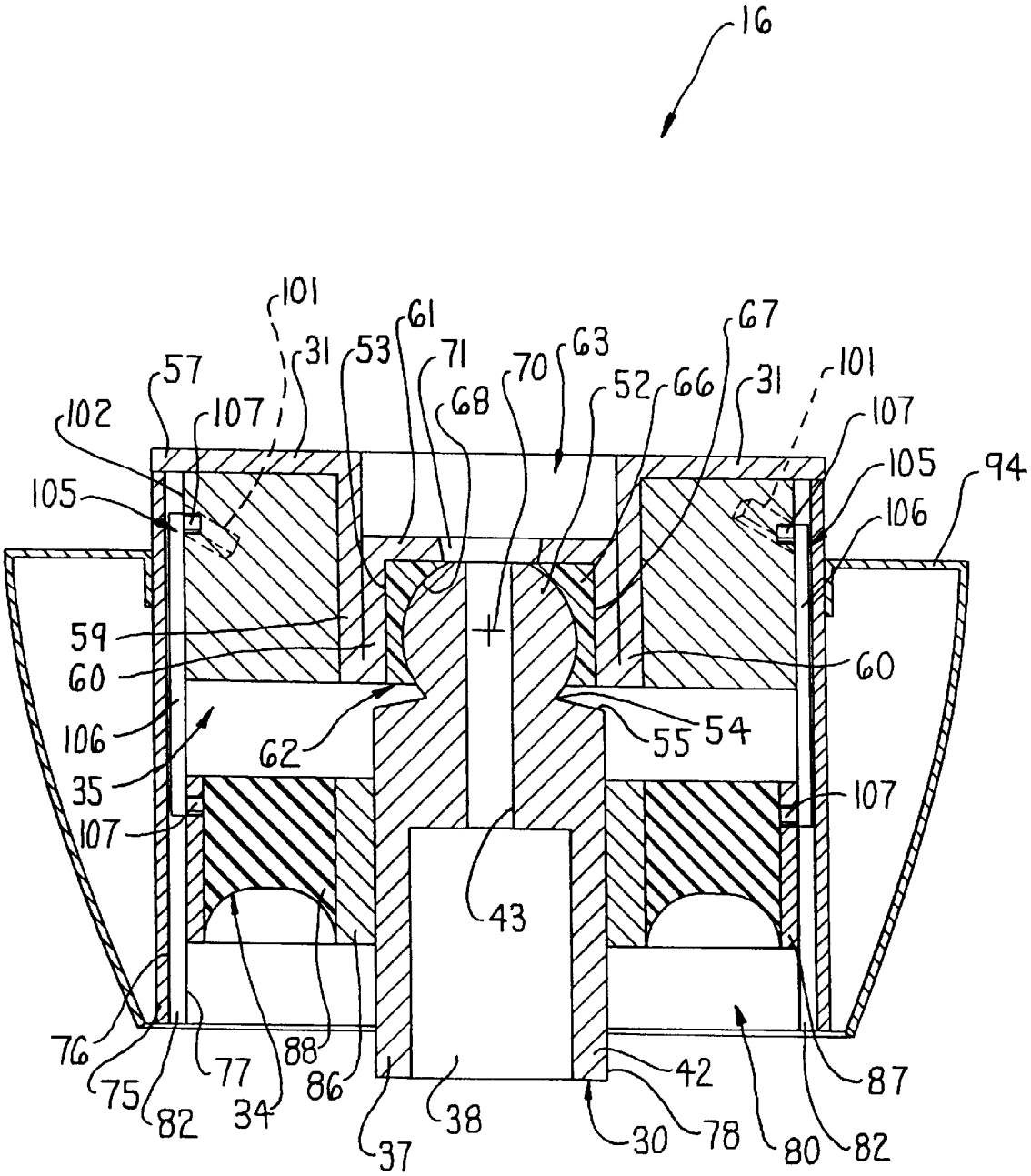
FIG. 4 is a side view of the tilt control mechanism in cross-section as taken along line 4—4 in FIG. 3.

Referring to FIGS. 2 and 4, the support fitting or member 30 is a vertically-elongate cylindrical tube which is rigidly connected to the upper end of the spindle 20 (FIG. 1) in coaxial relation therewith such that the support fitting 30 defines a vertical extension of the spindle 20. The lower end 37 of the support fitting 30 preferably defines an interior chamber 38 which opens downwardly to receive the upper end of a pneumatic cylinder 39 (FIG. 2) therein.

The pneumatic cylinder 39 is provided in the spindle 20 when the base 12 is height adjustable. The pneumatic cylinder 39 thereby adjusts the vertical length of the spindle 20 to adjust the height of the seat assembly 22, which arrangement is conventional.

To provide access to the pneumatic cylinder 39, the interior chamber 38 of the support fitting 30 is defined by an outer wall 42 which thickens significantly at an upper end thereof to define a bore 43 that extends vertically from the chamber 38 to the top end of the support fitting 30 and receives an actuator rod 44 vertically therethrough. The actuator rod 44 has a lower end connected to a valve on the pneumatic cylinder 39 and an upper end which projects vertically from the top of the support fitting 30.

To move the actuator rod 44 vertically, the tilt mechanism 16 is adapted to support a height adjustment handle 46 (FIGS. 1 and 2) which acts on the actuator rod 44 to operate the pneumatic cylinder 39. The height adjustment handle 46 includes a shaft 47 which extends horizontally into the tilt mechanism 16 and has a paddle-like flange 48 on the innermost end thereof. The flange 48 is disposed directly above the actuator rod 44, and the shaft 47 is rotatable about its longitudinal axis to move the actuator rod 44 vertically by movement of the flange 48 which thereby operates the pneumatic cylinder 39 to adjust the overall height of the base 12.

To pivotally support the seat assembly 22, the support fitting 30 further includes a ball 52 on the upper end thereof. The ball 52 is formed integral with the tubular wall 42 of a rigid wear-resistant material such as steel and has a generally spherical shape. As a result, the ball 52 has an outer surface 53 which preferably defines a convex partially spherical bearing surface that primarily faces upwardly but also extends downwardly and inwardly to form an annular groove 54 and an annular upward-facing shoulder 55 near the outer wall 42. The shoulder 55 tapers slightly downwardly.

The retainer bracket 31 seats on the ball 52 to define a pivot connection therewith. Since the retainer bracket 31 is also rigidly connected to the seat assembly 22, tilting of the seat assembly 22 causes the retainer bracket 31 to pivot (i.e. swivel) relative to the support fitting 30.

More particularly, the retainer bracket 31 has a ring-like mounting flange 57 which extends generally horizontally and is rigidly connected to the housing 23 of the seat assembly 22. The flange 57 has a circular shape when viewed from above although other shapes may be provided so long as the flange 57 can be connected to or otherwise support the seat housing 23.

An inside diameter of the flange 57 is formed integral with a cylindrical collar 59 which extends downwardly. The cylindrical collar 59 includes an outer wall 60 which extends vertically, and a divider wall 61, which extends horizontally from the outer wall 60, generally midway between the top and bottom edges of the outer wall 59 as shown in FIG. 4. The collar 59 thereby defines a bushing seat 62 which is defined below the divider wall 61, and a shaft chamber 63 which is defined above the divider wall 61.

In the illustrated embodiment, the retainer bracket 31 is formed of steel plate or other rigid material which is formed into the desired shape. During forming, the plate material is folded downwardly, upwardly and inwardly to define the collar 59 and divider wall 61 such that the collar 59 has multiple layers of plate material while the divider wall 61 extends radially inwardly from the outer wall 60.

To connect the retainer bracket 31 to the support fitting 30, the bushing seat 62 receives a generally diametrically split cylindrical bushing 66 through the open bottom of the collar 59. The bushing 66 includes an outer circumferential surface 67 which is tight-fittingly received within the wall 60, and a generally spherical bearing surface 68 on the hollow interior thereof which faces downwardly. The bearing surface 68 has a concave shape which corresponds to the convex shape of the ball 52, and the bushing 66 is secured in the collar 59 of the retaining bracket 31 and is also fitted onto the ball 52 such that the opposing bearing surfaces 68 and 53 are in slidable contact with each other.

The retainer bracket 31, bushing 66 and ball 52 thereby define a pivot connection between the chair base 12 and the seat assembly 22. To reduce friction, the bushing 66 preferably is formed of acetal or equivalent similar materials.

Since the opposing bearing surfaces 53 and 68 extend circumferentially and are generally spherically curved, a pivot point 70 is defined at the center of the ball 52, about which the entire seat assembly 22 pivots or swivels. In particular, the seat assembly 22 is able to vertically pivot in any horizontal direction that extends radially outwardly from the pivot point 70 and can also be swiveled about the connection point. This universal tilting of the seat assembly 22 thereby allows the seat assembly 22 to tilt and, in effect, to react to movements by the chair occupant whether forwardly, rearwardly, sidewardly, or any direction therebetween.

To assist in securing the bushing 66 to the ball 52, the bearing surface 68 of the bushing 66 preferably converges radially inwardly into the groove 54 formed on the ball 52. While the resilient ring 34 resists and limits the universal tilting as described herein, the bushing 66 and outer wall 60 also may swing downwardly and contact the shoulder 55 if tilting of the seat assembly 22 is excessive. The shoulder 55 thereby defines a positive stop which in this embodiment is annular to provide a symmetrical stop that limits tilting equally in all directions. Alternatively, an asymmetric positive stop may also be provided.

In the preferred embodiment, the opening 71 has a sufficiently large diameter so as to avoid contact with the actuator rod 44. To achieve this result, the opening 71 preferably has a circular shape when viewed from above (FIG. 3) and tapers upwardly outwardly when viewed from the side (FIG. 4). However, the opening 71 may also be permitted to contact the actuator rod 44 to limit tilting and thereby act as a positive stop. If the opening 71 is circular as illustrated, the stop arrangement would be symmetric. To provide an asymmetric stop arrangement, the opening 71 may have an asymmetric shape such as an ellipse. More specifically, the major axis would extend in a forward and rearward direction to limit forward tilting to a first angle (such as 12 degrees), while the minor axis would extend sidewardly to limit sideward tilting to a second angle (such as 8 degrees) which is smaller than the first angle. Tilting which is between forward and sideward tilting would thereby be limited to an intermediate angle which varies between the first and second angles.

Still further, the opening 71 could have other asymmetric shapes to vary the tilt angles. For example, the opening 71 could be egg-shaped wherein forward tilting would be limited to a greater extent than rearward tilting.

Figure 3:
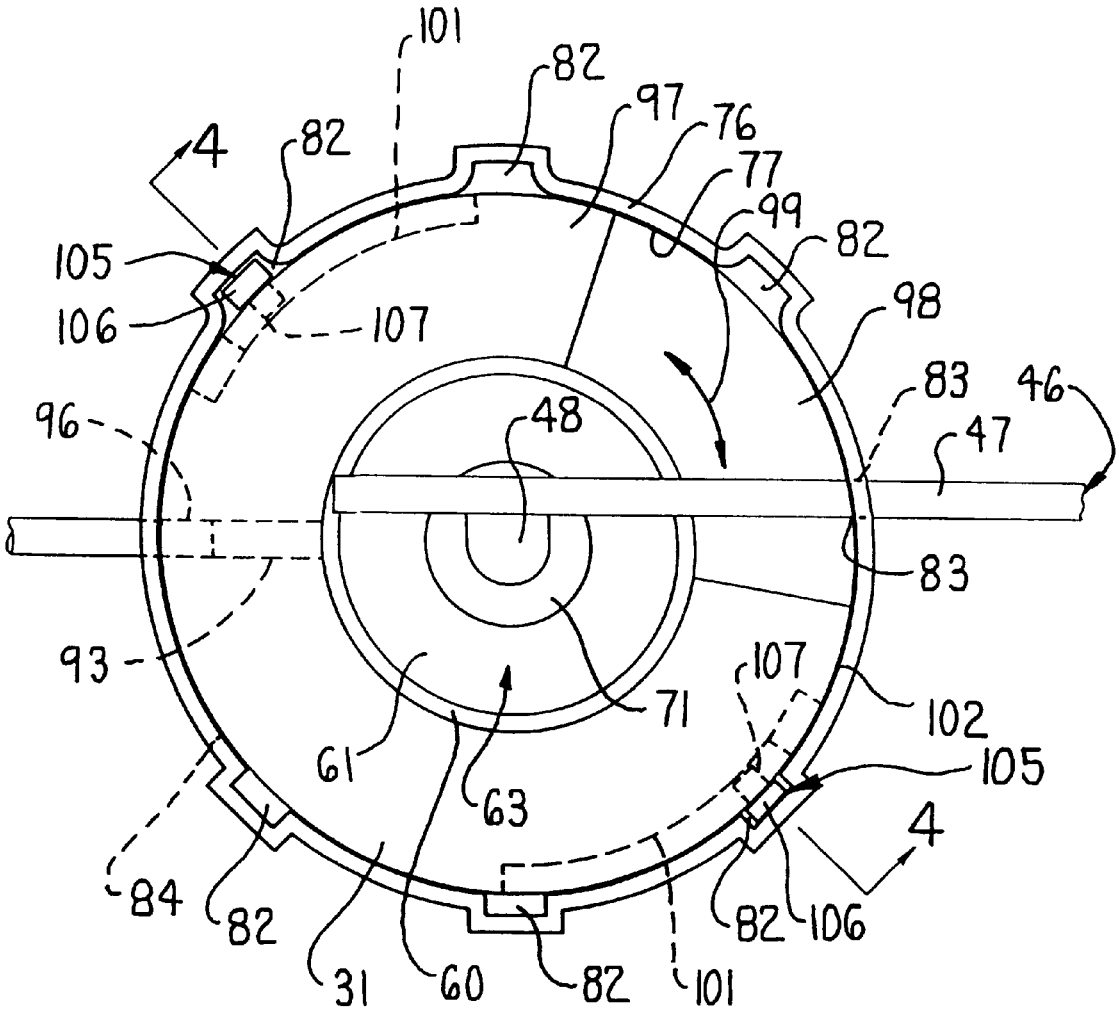
FIG. 3 is a plan view of the tilt control mechanism of FIG. 2 but with the housing top wall removed for purposes of illustration.
Figure 5:
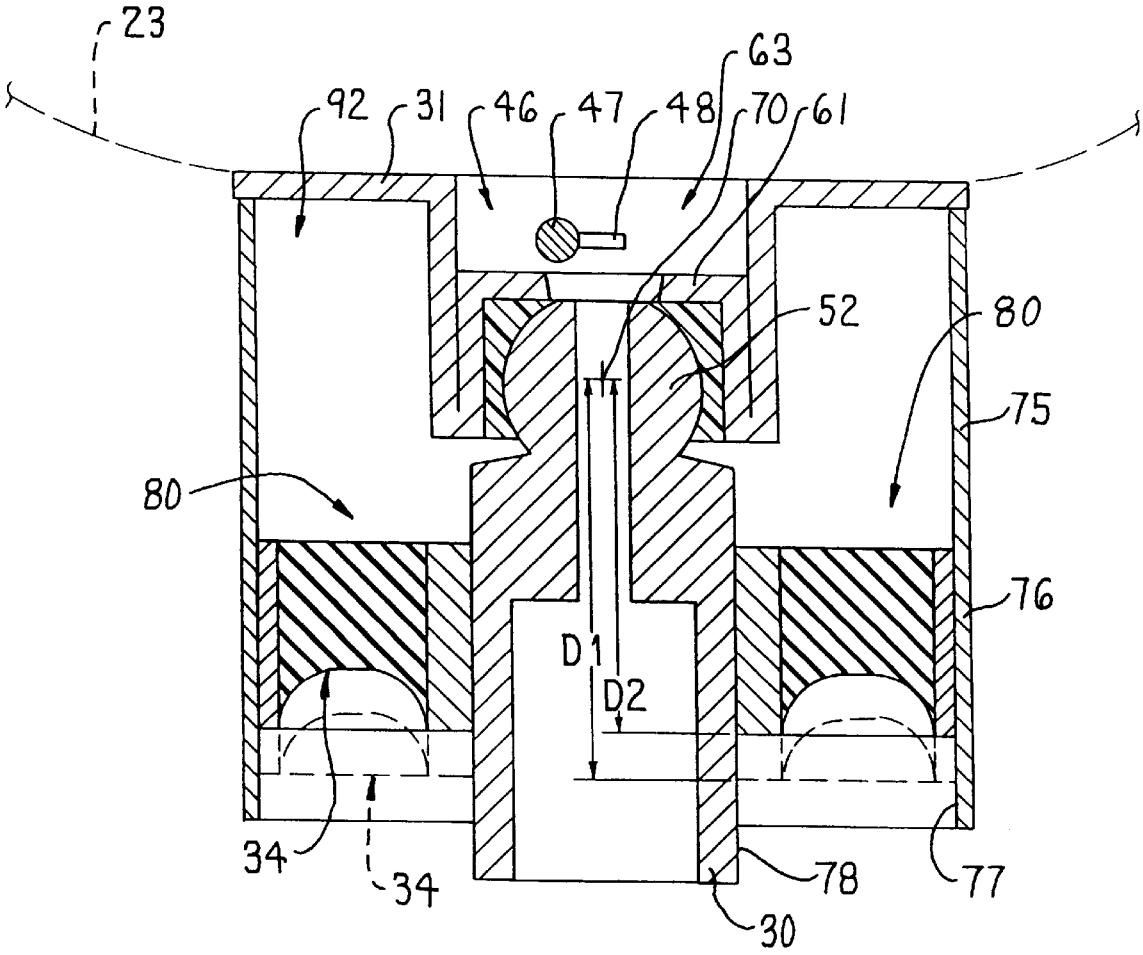
FIG. 5 is a diagrammatic side view of the tilt control mechanism in cross-section illustrating a resilient ring therein which is vertically movable.

To adjust the chair height, the retainer bracket 31 also supports the height adjustment handle 46 thereon. In particular, the handle shaft 47 is rotatably supported by opposite sides of the outer collar wall 60 and extends radially inwardly into the shaft chamber 63. As shown in FIGS. 3 and 5, the shaft 47 is offset from the center of the collar wall 60 such that the flange 48 is disposed above the opening 71 formed through the center of the divider wall 61.

As illustrated in FIG. 2, the actuator rod 44 extends vertically through this opening 71 such that rotation of the shaft 47 causes the flange 48 to drive the actuator rod 44 downwardly and actuate the pneumatic cylinder 39.

The retainer bracket 31 also supports a cylindrical housing 75 near the outer diameter of the mounting flange 57. The housing 75 is rigidly secured at the upper end thereof to the mounting flange 57, and includes an outer wall 76 having an interior surface 77 which is disposed coaxial and concentric with an outer surface 78 of the support fitting 30 when the seat-back is in its normal upright or neutral position.

The interior surface 77 and the outer surface 78 preferably are disposed in spaced apart relation such that an annular clearance space 80 is defined radially therebetween. The clearance space 80 extends vertically between the bottom of the housing 75 and the shoulder 55 formed on the support fitting 30. When the seat assembly 22 is in the neutral position (FIG. 1), the opposing, surfaces 77 and 78 preferably are parallel to each other such that the clearance space 80 has a uniform radial width along its vertical length.

Referring to FIG. 3, the outer housing wall 76 includes a plurality, here six, of circumferentially spaced vertical grooves 82 which extend vertically and open radially inwardly through the interior surface 77. As described herein, these grooves 82 serve as guides when the resilient ring 34 is moved vertically.

Figure 8:
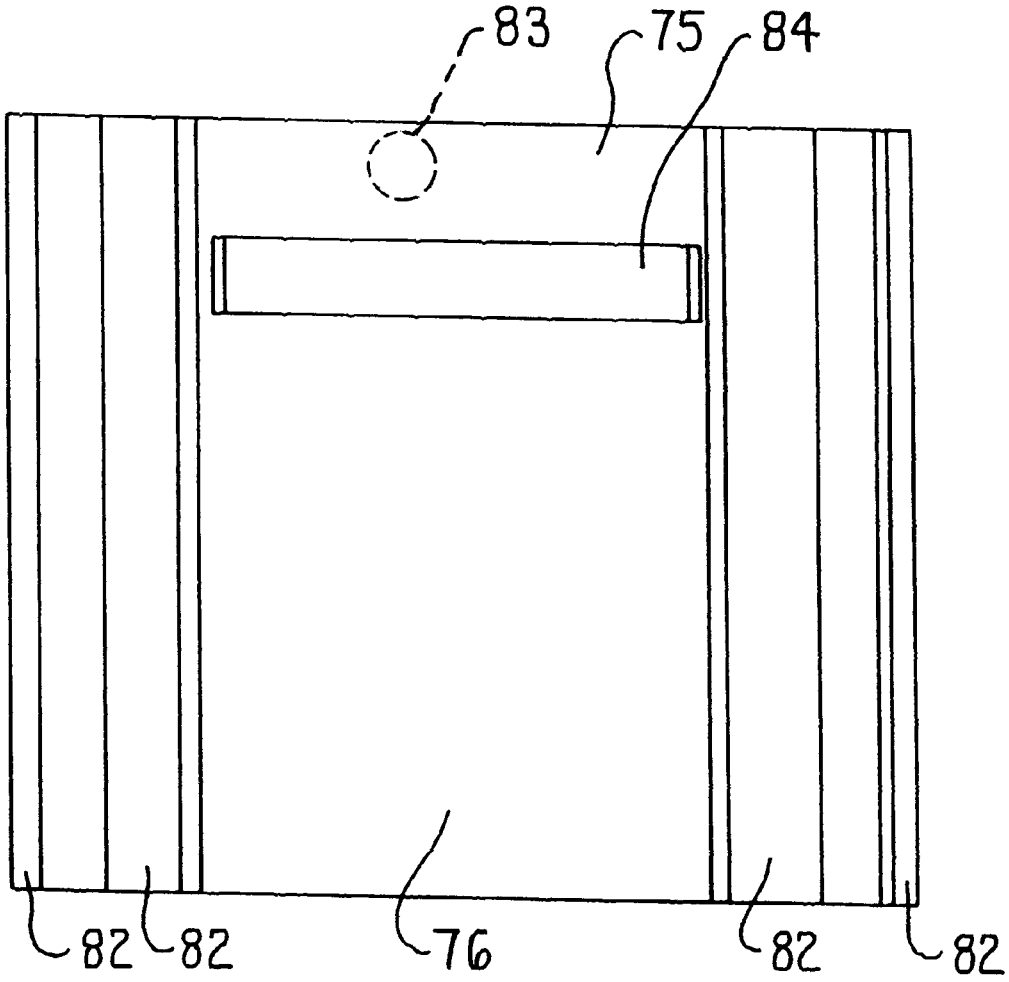
FIG. 8 is a side elevational view of a housing of the tilt control mechanism.

To support the height adjustment handle 46, the outer housing wall 76 includes a bore 83 (FIGS. 2 and 3) which rotatably supports the handle shaft 47. The housing wall 76 also includes a horizontally elongate rectangular slot 84 (FIGS. 2 and 8) on the side opposite the bore 83.

Figure 6:
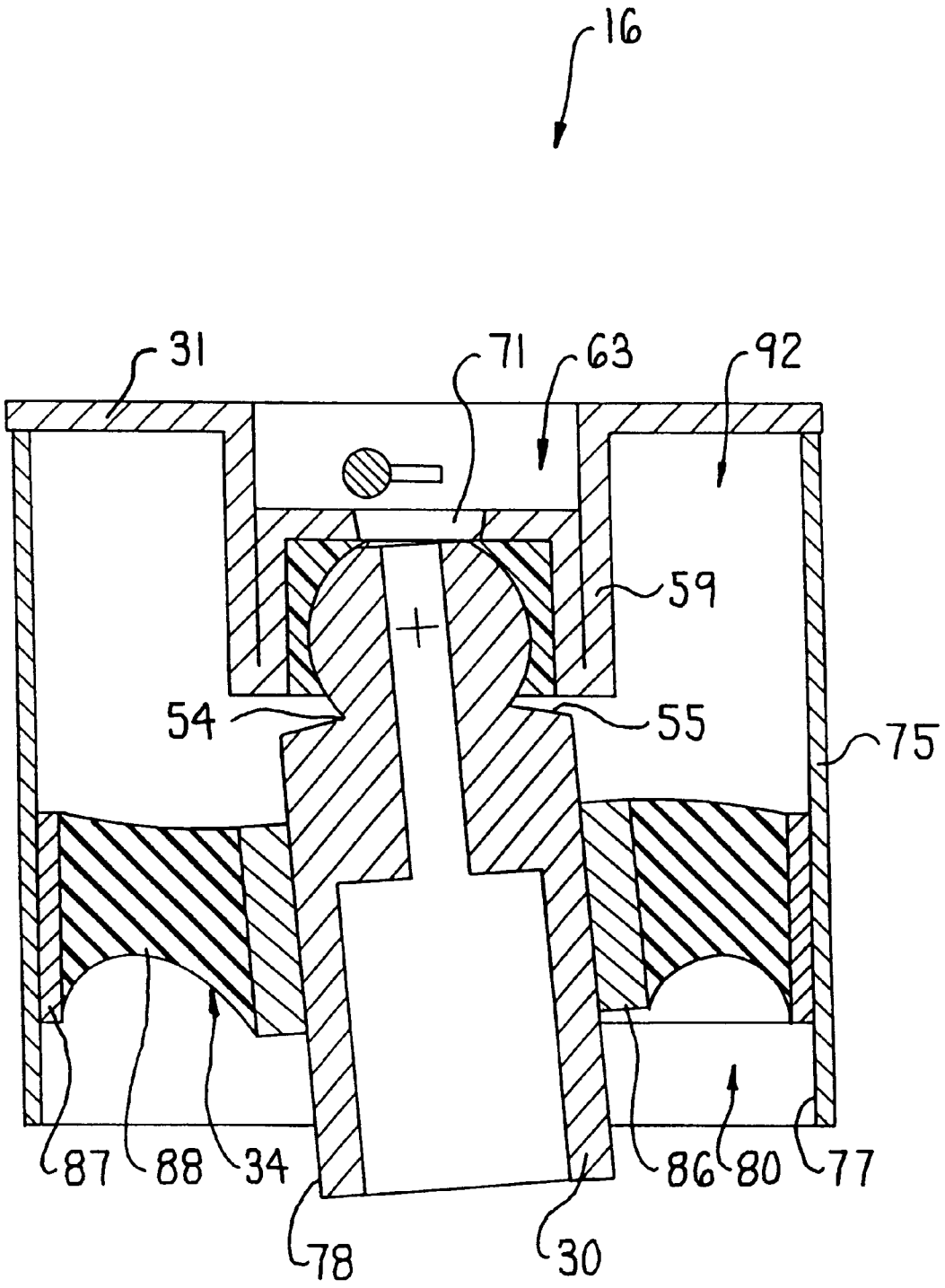
FIG. 6 illustrates the tilt control mechanism in a tilted position.

Since the housing 75 is connected to the retainer bracket 31, the housing 75 moves with the seat assembly 22 during tilting thereof. During tilting, the lower edge of the housing 75 on one side thereof moves toward the support fitting 30 as generally shown in FIG. 6, and relative movement occurs between the opposing surfaces 77 and 78.

To control tilting, the resilient ring 34 is provided in the clearance space 80 as shown in FIG. 4. In particular, the resilient ring 34 has an annular shape which fits into the clearance space 80 in concentric relation with the support fitting 30 and the housing 75. The resilient ring 34 has a radial width which fits closely between the opposing surfaces 77 and 78 but permits vertical sliding within the clearance space 80.

Preferably, the resilient ring 34 comprises an inner band 86 and an outer band 87 which define inner and outer diameters, respectively, of the ring 34. The inner and outer bands 86 and 87 are formed of metal to resist wear as the resilient ring 34 moves vertically along the axial length of the clearance space 80 although other suitable materials may be used and either or both bands 86 and 87 could be eliminated.

The inner and outer bands 86 and 87 are joined together by an elastomeric material 88 which extends radially therebetween and permits the inner and outer bands 86 and 87 to move relative to each other. The material 88 is preferably bonded or adhesively secured to the bands 86 and 87. Any suitable resilient and durable material may be used. In the preferred embodiment, the elastic material 88 is a natural rubber of 40–60 durometers.

During tilting of the chair 10, the housing 75 moves relative to the support fitting 30 which thereby compresses the resilient material 88 on one side of the support fitting 30 and stretches the resilient material 88 on a diametrically opposite side thereof as shown in FIG. 6. This compression and stretching serve to resist tilting of the seat assembly 22 and, in particular, generates a force acting on the housing 75 which increases as the angle of tilt increases. When the load on the seat assembly 22 is released, the resilient ring 34 biases the housing 75 and restores the seat assembly 22 to the neutral position.

While the housing 75 is disposed radially outwardly of the resilient ring 34, this arrangement may be modified, for example, by positioning the resilient ring 34 about the exterior of the housing 75 and providing a further annular housing which is fixed to the base 12 and is disposed radially outwardly of the resilient ring. In this modified arrangement, the resilient ring would still be positioned between a fixed surface and a movable surface which moves in response to tilting of the seat assembly. As a result, the resilient ring resists tilting and biases the seat to the neutral upright position.

To vary the biasing force being applied to the housing 75, the resilient ring 34 is vertically movable. In particular, as shown in FIG. 5, vertical movement of the resilient ring 34 varies the vertical distance between the resilient ring 34 and the pivot point 70, for example, from distance D1 to distance D2 which thereby varies the tilting resistance (i.e. torque).

Figure 7:
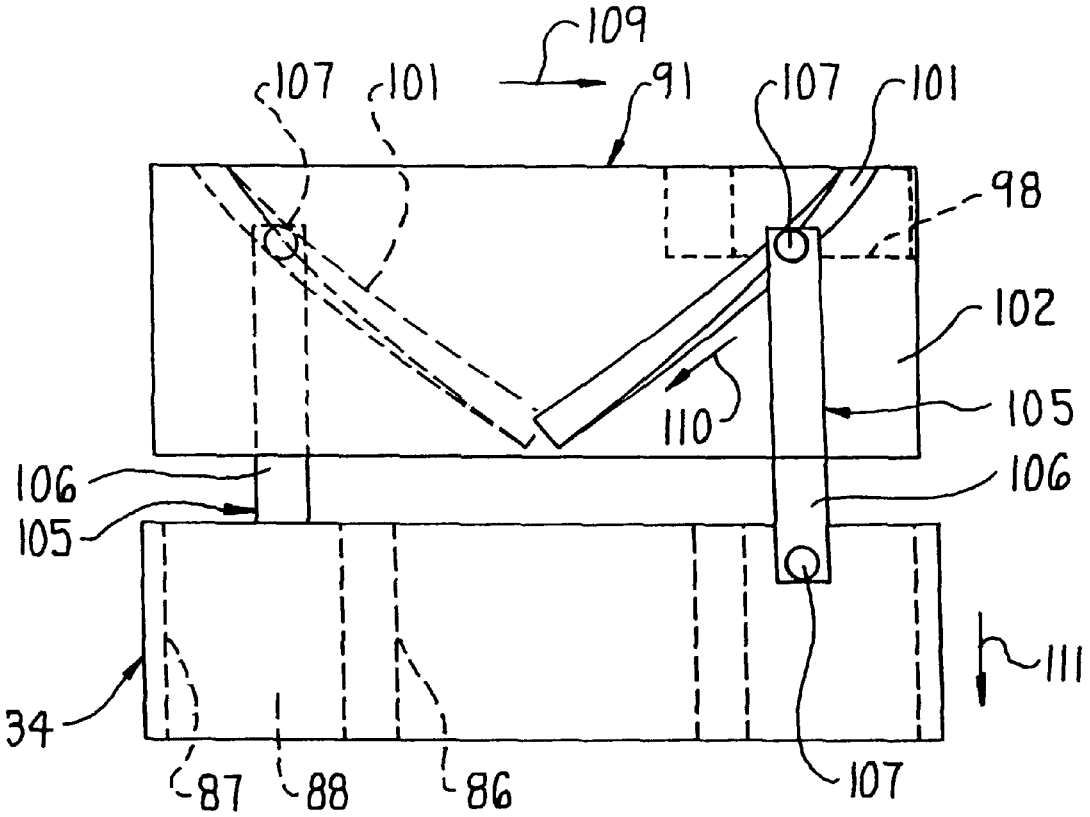
FIG. 7 is a front elevational view illustrating the resilient ring and a ring-like drive member for moving the resilient ring vertically.

To adjust the position of the resilient ring 34, the adjustment mechanism 35 is connected to the resilient ring 34 to permit manual adjustment of the tilting resistance. As shown in FIGS. 2, 3 and 7, the adjustment mechanism 35 includes a rotatable drive member such as a drive ring 91 disposed within the upper end of the housing 75. The drive ring 91 has an annular shape and fits concentrically in the radial space 92 between the collar wall 60 and the housing wall 76. The drive ring 91 fits closely but is rotatable within this radial space 92 as described herein.

To effect manual rotation of the drive ring 91, the drive ring 91 includes a horizontal bore 93 which extends radially therethrough. The bore 93 is aligned with the horizontal slot 84 in the housing 75 such that an adjustment handle 96 for tilting resistance extends radially through the slot 84 and into the bore 93 as shown in FIG. 2. The handle 96 is confined vertically in the slot 84 but is movable horizontally therealong such that the handle 96 can be swung manually in a horizontal plane to effect rotation of the drive ring 91. The opposite ends of the slot 84, however, limit the range of motion for the drive ring 91.

Preferably, the handle 96 is threadedly engaged with the bore 93 so that confinement of the handle 96 in the slot 84 prevents vertical movement of the drive ring 91. During assembly, the drive ring 91 is first slid into the radial space 92 and then the handle 96 is engaged therewith such that handle 96 prevents removal of the drive ring 91 and the resilient ring 34 which is connected thereto.

The handle 96 also supports a cylindrical shroud 94 for enclosing the tilt mechanism 16. The shroud 94 generally has a tapered shape and rotates in combination with the handle 96.

To accommodate the height adjustment handle 46, the upper surface 97 of the drive ring 91 also includes a generally pie shaped notch 98 opening upwardly therefrom. The notch 98 permits the height adjustment handle 46 to extend radially therethrough, and extends circumferentially to permit the drive ring 91 to be rotated. As the drive ring 91 rotates, the handle shaft 47 slides horizontally along the notch 98 as indicated generally by arrow 99 in FIG. 3.

To translate rotational movement of the drive ring 91 into vertical movement of the resilient ring 34, the drive ring 91 also includes a plurality and preferably two inclined slots 101 in the outer circumferential surface 102 thereof. When viewed from above as shown in FIG. 3, an upper end of each slot 101 opens upwardly through the upper ring surface 97, while an open side opens radially through the outer circumferential surface 102.

The slots 101 angle downwardly and circumferentially away from the upper ring surface 97 as shown in FIG. 7. Preferably, the slots 101 extend clockwise away from the upper surface 97, and the drive ring 91 is formed of nylon or of other suitable plastic material.

To effect vertical movement of the resilient ring 34, the adjustment mechanism 35 also includes an intermediate connector or tie bracket 105 for each one of the slots 101. In particular, a pair of tie brackets 105 are provided to connect or tie the drive ring 91 and the resilient ring 34 together.

Referring to FIGS. 3 and 7, each tie bracket 105 includes a vertically elongate bar 106 and a cylindrical pin 107 at each opposite end thereof. The lowermost pin 107 fits into a corresponding bore formed radially in the outer band 87 of the resilient ring 34. When the tie brackets 105 are connected to the resilient ring 34 as shown in FIG. 4, the resilient ring 34 is movable vertically with the tie bracket 105. When assembled, the bar 106 of each tile bracket 105 fits into and slides vertically in the groove 82 formed in the inside of the housing 75 whereby the grooves 82 guide vertical sliding of the resilient ring 34.

The uppermost pin 107 of the tie brackets 105 is slidably received in a corresponding one of the slots 101 and is slidable therealong. Thus, as the drive ring 91 is rotated, the upper pins 107 slide along the circumferential length of the slots 101 although, since the slots 101 are inclined, the rotation of the drive ring 91 effects vertical movement of the tie brackets 105 and the resilient ring 34 which is connected thereto. For example, as shown in FIG. 7, rotation of the drive ring 91 counterclockwise in the direction of arrow 109 causes the upper pin 107 to move relative to the slot 101 in the direction of arrow 110 which thereby causes the resilient ring 34 to move downwardly in the direction of arrow 111 and adjust the resistance force.

With the above-described arrangement, the chair 10 not only provides universal tilting but the tilting resistance is adjustable to accommodate different size users or to provide different tilting characteristics.

In operation, the seat assembly 22 can tilt about the pivot point 70 in any direction extending radially away from the pivot point. As the seat assembly 22 tilts, the housing 75 moves relative to the support fitting 30 which thereby compresses the resilient ring 34 on one side thereof. This compression of the resilient ring 34 generates a resistance force which is applied to the housing 75 by the resilient ring 34. Once tilting is completed, the resiliency of the ring 34 causes the seat assembly 22 to return to its neutral position.

Since resistance to tilting may need to be adjusted depending upon the characteristics and requirements of an occupant, the resilient ring 34 is vertically movable to adjust the distance between the pivot point 70 and the location on the housing 75 to which the resistance force is applied.

The position of the resilient ring 34 is adjusted by moving the handle 96 clockwise or counterclockwise. Rotation of the handle 96 causes the drive ring 91 to rotate which thereby causes the resilient ring 34 to move vertically due to the cooperation of the tie brackets 105 and inclined slots 101. In particular, rotation of the drive ring 91 causes relative vertical and horizontal movement between the slots 101 and the pins 107 of the tie brackets 105. As a result, the chair 10 of the invention provides universal tilting and ready adjustment of the resistance forces to improve the comfort and health of an occupant.

Figure 9:
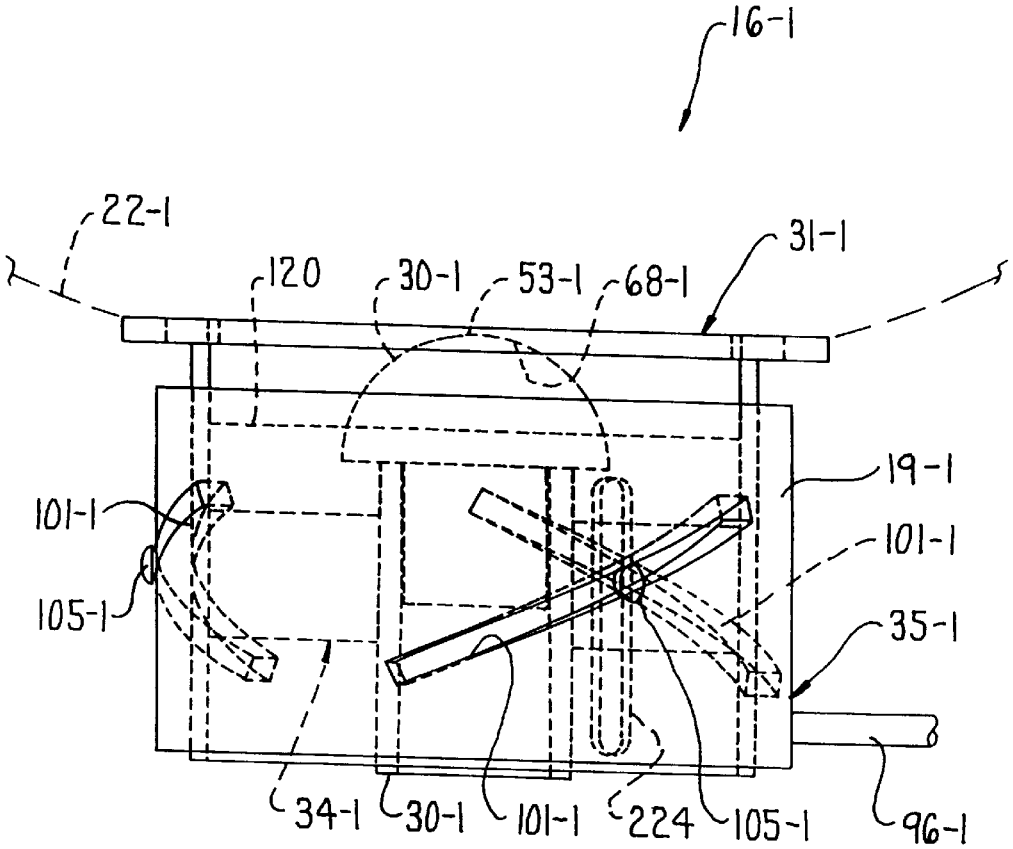
FIG. 9 is a front elevational view of a second embodiment of the tilt control mechanism.
Figure 10:
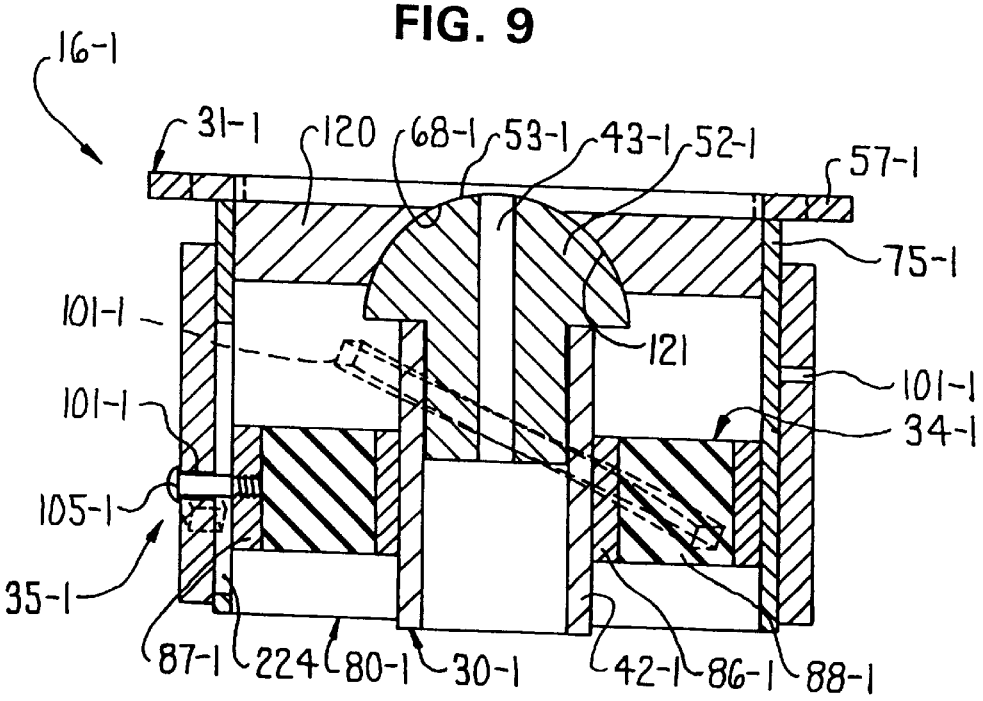
FIG. 10 is a front cross sectional view of the embodiment of FIG. 9.

FIGS. 9 and 10 illustrate a second embodiment for the tilt control mechanism 16-1. The second embodiment incorporates a number of common components as described herein, which common components are designated by the same reference numeral in combination with "−1". These common components have similar structures and functions to those described above, and the following disclosure is directed primarily to the differences therebetween.

More particularly, the tilt control mechanism 16-1 includes a support fitting 30-1 which is supported on the base 12, and includes a cylindrical outer wall 42-1 to which a ball 52-1 is attached. The ball 52-1 defines a convex bearing surface 53-1 which faces upwardly. A central bore 43-1 also is provided to permit actuation of a pneumatic cylinder as provided in a height-adjustable base.

The seat assembly 22-1 is pivotally connected to the support fitting 30-1 by a retainer bracket 31-1. The retainer bracket 31-1 includes a relatively thick central plate 120 which has a downward opening recess 121 at the center thereof. The recess 121 defines a concave bearing surface 68-1 which cooperates with the bearing surface 53-1 to define a pivot connection therebetween.

The retainer bracket 31-1 also includes an annular mounting flange 57-1 and a cylindrical housing 75-1 which projects downwardly therefrom in concentric relation with the support fitting 30-1. Similar to the embodiment of FIGS. 1–9, the housing 75-1 moves relative to the support fitting 30-1 and compresses a resilient ring-like member 34-1 therebetween.

An adjustment mechanism 35-1 also is provided to move the resilient ring 34-1 vertically. As described herein, the adjustment mechanism 35-1 cooperates with a plurality and preferably three vertically elongate slots 224 which are formed through the housing 75-1 and are angularly spaced apart.

The adjustment mechanism 35-1 operates substantially the same as the above-described adjustment mechanism 35 in that a rotational driving motion is converted into vertical movement of the resilient ring 34-1. However, the drive member 19-1 herein is cylindrical rather than ring-shaped and is disposed radially outwardly of the resilient ring 34-1 rather than vertically aligned as in the first embodiment of FIGS. 1–9.

The drive cylinder 19-1 fits over the outside of the housing 75-1 in concentric relation therewith, and is rotatable by manual movement of an actuator handle 96-1 which projects radially outwardly therefrom. The drive cylinder 19-1 includes a plurality and preferably three inclined slots 101-1 which extend both circumferentially and vertically. The slots 101-1 extend entirely through the wall of the drive cylinder 19-1 and are aligned in communication with the vertical slots 224.

To adjust tilting resistance, the drive cylinder 19-1 and the resilient ring 34-1 are coupled together by intermediate connectors 105-1. The intermediate connectors 105-1 are formed as pins which have a threaded end that is inserted horizontally through the aligned inclined grooves 101-1 and vertical slots 224 and is threadedly engaged with the outer band 87-1 on the resilient ring 34-1. As a result, manual rotation of the drive cylinder 19-1 causes the pins 105-1 to move vertically as they slide along the grooves 101-1, whereby the pins 105-1 move vertically up or down the slots 224 to effect a corresponding vertical movement of the resilient ring 34-1.

These pins 105-1 also permit the resilient ring 34-1 to be inserted into the annular clearance space 80-1 and then secured in place since the pins 105-1 are confined vertically within the slots 224. As can be seen, the drive member thereby may be formed as a cylinder disposed radially outwardly of the housing 75-1 and resilient ring 34-1.

Figure 11:
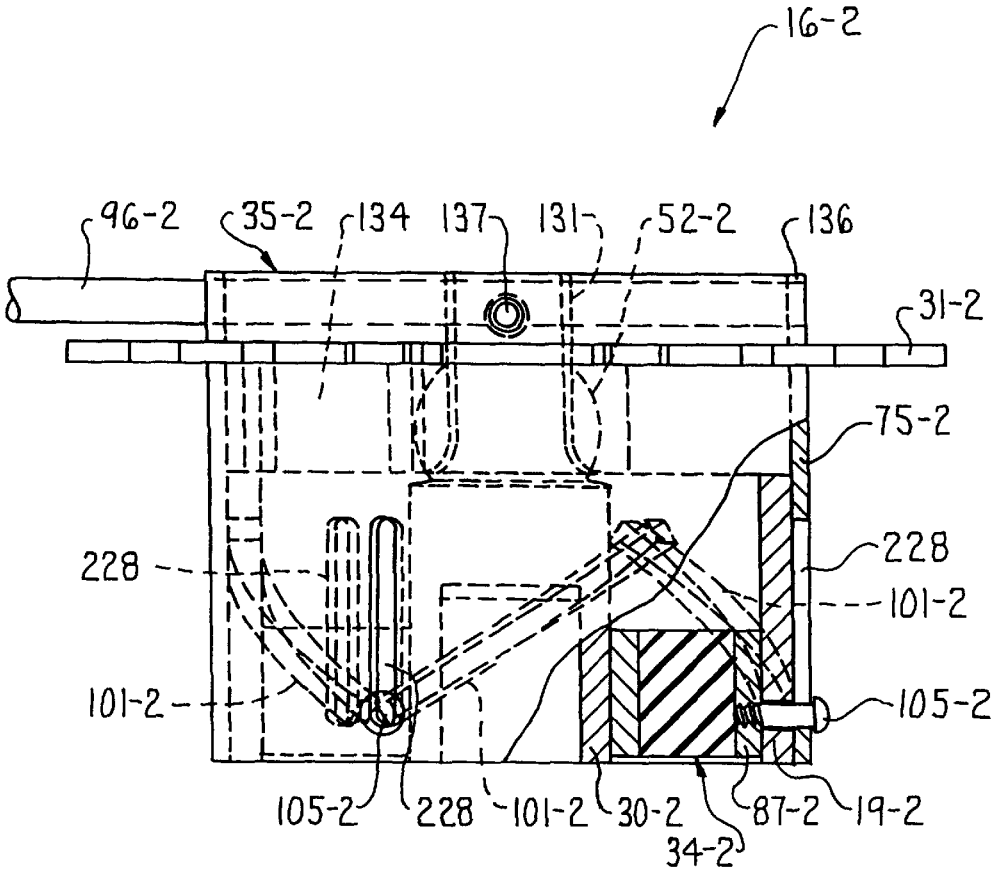
FIG. 11 is a front elevational view in partial cross section of a third embodiment of the invention.
Figure 12:
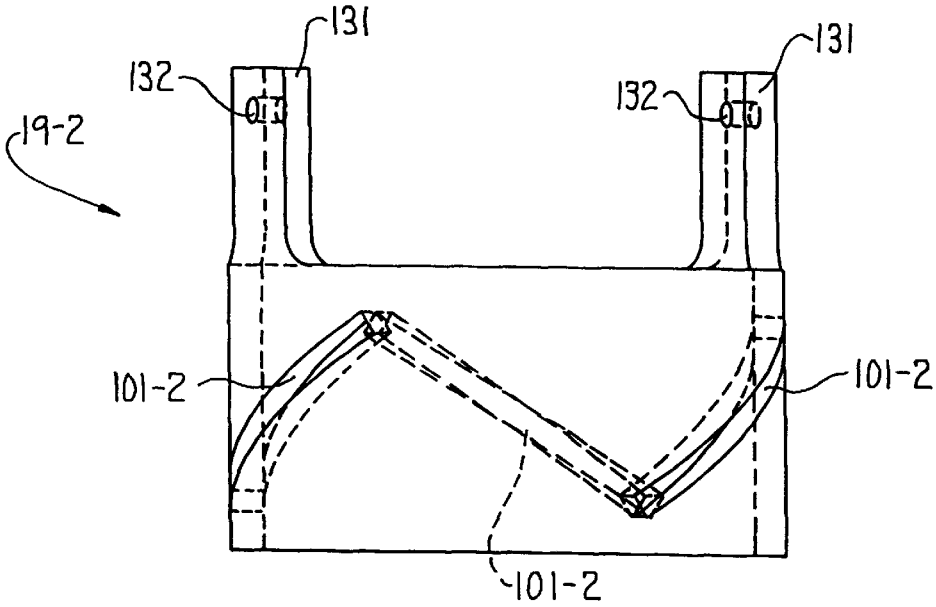
FIG. 12 is a side elevational view of a drive cylinder for an adjustment mechanism for the embodiment of FIG. 11.
Figure 13:
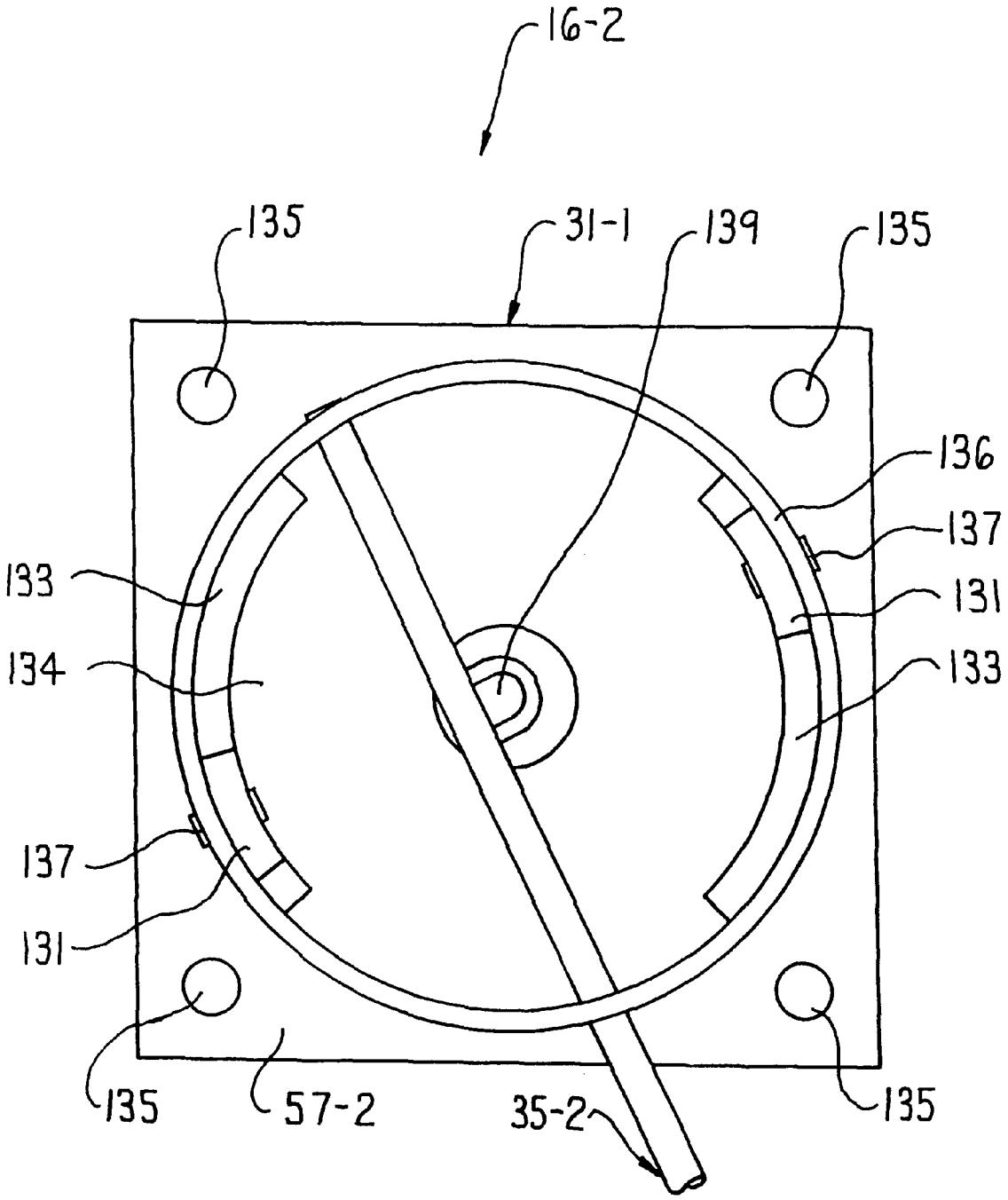
FIG. 13 is a plan view of the third embodiment.

Alternatively, referring to FIGS. 11–13, a third embodiment of the tilt control mechanism 16-2 is illustrated. In this alternate embodiment, a drive cylinder 19-2 is located radially inwardly of a housing 75-2 directly next to a resilient ring 34-2 which is in contact therewith.

The tilt control mechanism 16-2 is formed similar to the first and second embodiments in that a retainer bracket 31-2 is pivotally connected to the ball 52-2 of a support fitting 30-2. The pivot connection defined thereby provides substantially the same universal tilting movement as provided by the above-described embodiments.

The retainer bracket 31-2 further includes the cylindrical housing 75-2 formed similar to the housing 75-1 in that a plurality and preferably three vertically elongate slots 228 are spaced equally about the housing 75-2. The slots 228 are formed the same as the slots 124 and cooperate with the adjustment mechanism 35-2 in the same manner as described herein.

The drive cylinder 19-2 in this third embodiment, however, is located radially between the resilient ring 34-2 and the housing 75-2 such that the resilient ring 34-2 acts on and slides along the drive cylinder 19-2. Nevertheless, the resilient ring 34-2 effectively acts on the housing 75-2 since the housing 75-2 is in slidable contact with the drive cylinder 19-2, such that the resilient ring 34-2 defines a tilting resistance.

With this arrangement, intermediate connector pins 105-2 project radially through the vertical slots 228 and the inclined grooves 101-2 which are formed in the drive cylinder 19-2, and then threadedly engaged with the outer band 87-2 of the resilient ring 34-2. Thus, rotation of the drive cylinder 19-2 causes vertical movement of the resilient ring 34-2 in the same manner as described previously.

To effect rotation of the drive cylinder 19-2, a pair of ears 131 project upwardly therefrom as seen in FIG. 13. In particular, the ears 131 are diametrically opposed and project upwardly through a pair of arcuate slot-like tracks 133 formed in a central plate 134 of the retainer bracket 31-2. The ears 131 are curved when viewed from above as seen in FIG. 13, and therefore are able to slide horizontally along the tracks 133.

The retainer bracket 31-2 also includes a mounting flange 57-2 which extends radially outwardly of the tracks 133 and ears 131 and includes mounting holes 135 (FIG. 13) which receive fasteners (not illustrated) therethrough to connect the retainer bracket 31-2 to the seat assembly. To secure the drive cylinder 19-2 to the retainer bracket 31-2, a mounting ring 136 is connected to the ears 131 by fasteners 137 (FIGS. 11 and 13). The fasteners 137 extend through corresponding holes 132 (FIG. 12) formed in the ears 131. When connected together, the mounting ring 136 is slidably supported on top of the flange 57-2.

To rotate the drive cylinder 19-2, an actuator handle 96-2 projects through diametrically opposed sections of the mounting ring 136 as seen in FIG. 13. Thus, horizontal movement of the handle 96-2 causes rotation of the mounting ring 136 and a corresponding rotational movement of the drive cylinder 19-2. This movement thereby adjusts the vertical position of the resilient ring 34-2 due to the above-described cooperation of the slots 101-2, grooves 228 and pins 105-2.

The actuator handle 96-2 also is rotatable about its horizontal longitudinal axis to serve as an actuator for a pneumatic cylinder. In particular, the handle 96-2 includes a cam projection 139 which overlies an opening 71-2 formed in the central plate 134, which opening 71-2 provides access to the valve of the pneumatic cylinder. An actuator rod, like actuator rod 44, preferably is connected between the pneumatic cylinder and the cam projection 139 such that rotation of the handle 96-2 causes vertical actuation of the pneumatic cylinder. Thus, the handle 96-2 serves two functions.

In the above-described embodiments, the resilient ring 34 (34-1 and 34-2) is annular so as to act circumferentially around the support fitting 30. This annular shape is preferred since the resilient ring 34 provides a uniform resistance to universal tilting of the seat assembly 22.

In particular, the continuous ring provides for better transmission and generation of forces since the stretching and compressing of the material can be more readily transferred circularly around the entire ring, and this also leads to better durability. Also, the circular ring reacts the same irrespective of the plane of vertical tilt and thus provides good and uniform tilt resistance whether tilt is to front, back, side, or any angle therebetween.

While the elastic material 88 preferably is annular so as to extend around the entire resilient ring 34, the elastic material 88 may also be formed as separate elastomeric blocks or connectors which are connected radially between the inner and outer bands 86 and 87 but are circumferentially spaced apart. Further, the elastic material 88 could be a spring steel, formed, for example, as coil springs wherein the springs are circumferentially spaced apart like the elastomeric blocks.

Figure 14:
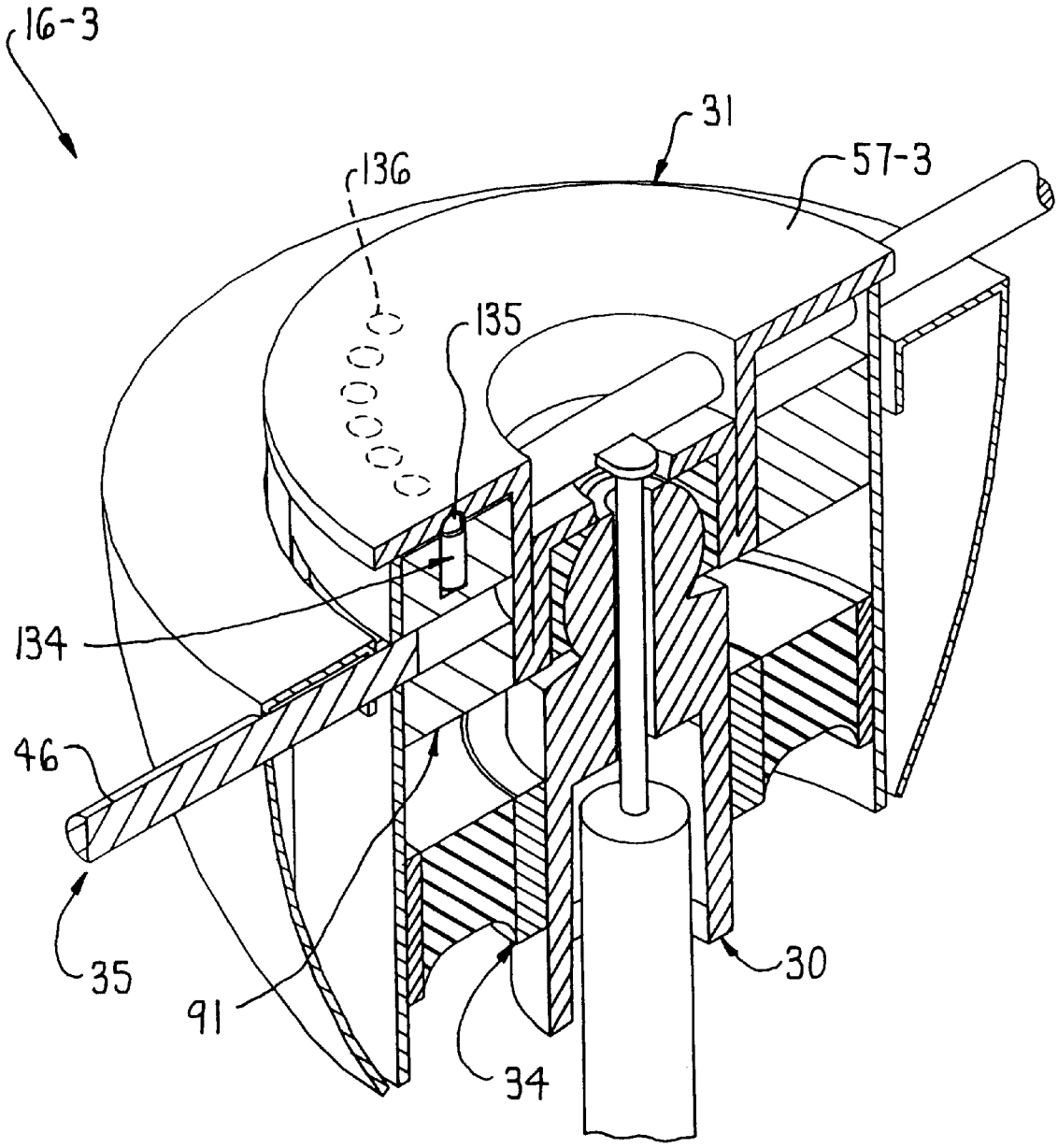
FIG. 14 is a partial perspective view in cross-section of a further embodiment of the tilt control mechanism.

Referring to FIG. 14, a further embodiment of the invention is illustrated. In particular, the tilt mechanism 16-3 as illustrated in FIG. 14 is substantially identical to the tilt control mechanism illustrated in FIGS. 1–8 and the prior disclosure relative to this first embodiment is equally applicable to FIG. 14. Generally, the tilt mechanism 16-3 includes a support fitting 30, resilient ring 34, retainer bracket 31 and an adjustment mechanism 35 having a drive ring 91. In the tilt control mechanism 16-3, however, a locking arrangement is provided which permits rotation of the drive ring 91 by the handle 46 but provides a locking effect to resist unwanted rotation of the drive ring 91.

In the illustrated embodiment of FIG. 14, the upper surface of the drive ring 91 includes a ball detent unit 134 which projects upwardly therefrom and is a commercially available component. The movable ball 135 of the ball detent unit 134 is removably engaged with one of a series of concave recesses 136 which receive the ball therein. The ball detent unit 134 is spring-loaded such that the ball 135 slides out of the corresponding recess 136 during rotation of the drive ring 91 but engages a further one of the recesses 136 once the drive ring is adjusted.

Other locking arrangements may also be provided. For example, a ratchet-like bracket may be provided on the exterior of the seat assembly where the tilt handle 46 engages one of a series of notches in the bracket. The handle 46, however, is slidable along the bracket to another one of the notches which again resists movement of the handle after adjustment. It will be appreciated that other suitable locking arrangements may also be provided to resist rotation of the drive ring 91.

Although particular embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A chair comprising:

a base;

a tilt control mechanism supported on said base; and a seat assembly pivotally connected to said base by said tilt control mechanism;

said tilt control mechanism defining a pivot connection connected to said seat assembly and said base about which said seat assembly pivots rearwardly and sidewardly in multiple tilt directions oriented transverse to each other, said tilt control mechanism including first and second surfaces which are disposed in opposing relation, said first surface being stationary relative to said base and said second surface being movable with said seat assembly during pivoting thereof in said multiple transverse directions, said first and second surfaces being radially spaced apart to define a clearance space therebetween, and said tilt control mechanism including a resilient member disposed in said clearance space and extending radially between said first and second surfaces, said resilient member being deformable as said second surface moves relative to said stationary first surface during pivoting of said seat assembly in any of said multiple tilt directions, said resilient member biasing said seat assembly to a neutral position; and said tilt control mechanism including an adjustment mechanism connected to said resilient member which adjusts a distance between said resilient member and said pivot connection.

2. A chair according to claim 1, wherein said first and second surfaces have an annular shape and said resilient member is an annular elastomeric ring which is movable toward and away from said pivot connection through said clearance space.

3. A chair according to claim 2, wherein said first and second surfaces are movable radially toward and away from each other during pivoting of said seat assembly and said elastomeric ring is displaceable vertically.

4. A chair according to claim 1, wherein said first and second surfaces and said resilient member are annular and disposed in coaxial relation with a central axis, said adjustment mechanism including an annular drive member disposed concentrically about said central axis, an actuator for rotating said drive member about said central axis, and an intermediate connector which connects said drive member to said resilient member and converts rotational movement of said drive member to axial movement of said resilient member.

5. A chair according to claim 4, wherein said drive member includes at least one inclined groove which extends circumferentially, said intermediate connector having one part slidably received in said inclined groove such that rotation of said drive member effects vertical displacement of said intermediate connector, an opposite part of said intermediate connector being connected to said resilient member such that said resilient member moves axially therewith.

6. A chair according to claim 1, wherein said resilient member includes rigid annular plates which are radially spaced from each other and are disposed closely adjacent to said first and second surfaces respectively when disposed in said clearance space and are connected radially together by elastomeric material extending radially therebetween.

7. A chair according to claim 1, wherein said pivot connection defines a pivot point about which said seat assembly pivots in any of said multiple directions, said multiple directions extending outwardly from said pivot point and being angularly offset relative to each other.

8. A chair comprising:

a base;

a tilt control mechanism supported on said base; and a seat assembly pivotally supported on said tilt control mechanism so as to pivot in a plurality of directions transverse to a vertical axis;

said tilt control mechanism defining a pivot connection connected to said seat assembly and said base about which said seat assembly pivots, said seat assembly being tiltable rearwardly and sidewardly in multiple directions oriented transverse to each other;

said tilt control mechanism including first and second annular surfaces which are disposed in opposing relation and are radially spaced apart from each other to define an annular clearance space therebetween, said second surface being movable relative to said first surface in response to tilting of said seat assembly;

said tilt control mechanism further including a resilient annular member disposed in said clearance space and extending radially between said first and second surfaces to resist movement of said second surface relative to said first surface during pivoting of said seat assembly in any of said transverse directions, said resilient member being movable toward and away from said pivot connection within said space to adjust the resistance to pivoting of said seat assembly and said tilt control mechanism includes an adjustment mechanism connected to said resilient ring to move said resilient member.

9. A chair according to claim 8, wherein said pivot connection defines a pivot point about which said seat assembly pivots and said resilient member has a one-piece annular shape.

10. A chair according to claim 9, wherein said first surface is defined by a support member which is supported on said base and said pivot connection includes a connector bracket which pivotally connects said support member to said seat assembly, said pivot bracket and said support member defining opposing bearing surfaces wherein one of said bearing surfaces is convex and the other of said bearing surfaces is concave.

11. A chair according to claim 9, wherein said tilt mechanism includes a support member supported on said base and a pivot bracket connected to said seat assembly, said support member including a convex bearing surface and said pivot bracket including a concave bearing surface disposed in opposing relationship with said convex bearing surface, said opposing bearing surfaces being slidable with respect to each other to define a pivot point about which said seat assembly is universally pivotable.

12. A chair according to claim 11, wherein said tilt control mechanism includes a plastic bearing which defines at least one of said bearing surfaces.

13. A chair according to claim 8, wherein said adjustment mechanism includes a drive member that has an inclined cam part and a connector slidably engaged with said inclined cam part, said connector being connected to said resilient member and said drive member being manually movable in a first direction to effect movement of said resilient ring in a second direction for adjusting the distance between said resilient member and said pivot connection.

14. A chair according to claim 13, wherein said resilient member is movable vertically relative to said pivot connection.

15. A chair comprising:

a base;

a seat assembly; and a tilt control mechanism connected to said base and said seat assembly so that said seat assembly can pivot relative to said base;

said tilt control mechanism defining a pivot connection connected to said base and said seat assembly about which said seat assembly pivots and including a resilient member which defines a resistance force which acts on said seat assembly to resist tilting thereof;

said tilt control mechanism further including an adjustment mechanism to adjust the resistance force, said adjustment mechanism including an intermediate connector which acts on said resilient member and is movable in a first direction to adjust said resistance force, a drive member which is movable in a second direction oriented transverse to said first direction and an actuator for moving said drive member in said second direction, said drive member including an inclined groove to which said intermediate connector is slidably connected, said inclined groove being inclined to extend in both of said first and second directions such that movement of said drive member in said second direction effects movement of said intermediate connector in said first direction to adjust said resistance force created by said resilient member.

16. A chair according to claim 15 wherein said second direction extends generally horizontally and said first direction extends generally vertically.

17. A chair according to claim 16, wherein said actuator is a handle extending outwardly away from said drive member below said seat assembly.

18. A chair according to claim 15, wherein said tilt control mechanism includes opposing first and second surfaces which are movable relative to each other during pivoting of said seat assembly, said resilient member acting on said first and second surfaces such that said resistance force resists said relative movement.

19. A chair according to claim 15, wherein said drive member is rotatable and the connection of said intermediate connector to said inclined groove translates rotational movement of said drive member to movement of said intermediate connector in said first direction.

20. A chair having a base, a seat, and a tilt control mechanism joined to said base and seat to permit vertical tilting of said seat, said tilt mechanism comprising a support bearing connected between said base and seat and defining a pivot point permitting universal tilting of said seat relative to said base about said pivot point, first and second supports fixed respectively to said seat and base and defining an annular space therebetween, a one-piece ring of elastomeric material engaged between said first and second supports and disposed concentrically with respect to a vertical axis containing said pivot point, and an adjusting device for vertically adjusting the relative positions of said ring and one of said supports to vary tilting resistance imposed on said seat, said adjusting device including a manually movable adjusting member disposed adjacent said seat.

21. A chair according to claim 20, wherein said ring includes rigid inner and outer bands.

22. A chair according to claim 20, wherein said adjusting member is movable horizontally and said adjusting device includes a connector arrangement which translates said horizontal movement of said adjusting member into vertical movement of said ring.

23. A chair comprising:

a base;

a tilt control mechanism supported on said base; and a seat assembly pivotally connected to said base by said tilt control mechanism;

said tilt control mechanism defining a pivot connection connected to said seat assembly and said base about which said seat assembly pivots rearwardly and sidewardly in multiple tilt directions oriented transverse to each other, said tilt control mechanism including first and second surfaces which are disposed in opposing relation, said first surface being stationary relative to said base and said second surface being movable with said seat assembly during pivoting thereof in said multiple transverse directions, said first and second surfaces having an annular shape and being radially spaced apart to define a clearance space therebetween wherein said first and second surfaces are movable radially toward and away from each other during pivoting of said seat assembly, and said tilt control mechanism including a resilient member disposed in said clearance space and extending radially between said first and second surfaces, said resilient member being an annular elastomeric ring which is displaceable vertically toward and away from said pivot connection through said clearance space and said resilient member being deformable as said second surface moves relative to said stationary first surface during pivoting of said seat assembly in any of said multiple tilt directions, said resilient member biasing said seat assembly to a neutral position.

24. A chair comprising:

a base;

a tilt control mechanism supported on said base; and a seat assembly pivotally connected to said base by said tilt control mechanism;

said tilt control mechanism defining a pivot connection connected to said seat assembly and said base about which said seat assembly pivots rearwardly and sidewardly in multiple tilt directions oriented transverse to each other, said tilt control mechanism including first and second surfaces which are disposed in opposing relation, said first surface being stationary relative to said base and said second surface being movable with said seat assembly during pivoting thereof in said multiple transverse directions, said first and second surfaces being radially spaced apart to define a clearance space therebetween, and said tilt control mechanism including a resilient member disposed in said clearance space and extending radially between said first and second surfaces, said resilient member being deformable as said second surface moves relative to said stationary first surface during pivoting of said seat assembly in any of said multiple tilt directions, said resilient member biasing said seat assembly to a neutral position, said resilient member including rigid annular plates which are radially spaced from each other and are disposed closely adjacent to said first and second surfaces respectively when disposed in said clearance space and are connected radially together by elastomeric material extending radially therebetween, said resilient member being movable in the clearance along the first and second surfaces in a direction transverse to a radial direction to vary the distance between the resilient member and the pivot connection.

* * * * *

UNITED STATES PATENT AND TRADEMARK OFFICE

CERTIFICATE OF CORRECTION

PATENT NO. : 6,209,958 B1
DATED : April 3, 2001
INVENTOR(S) : Douglas M. Thole

It is certified that error appears in the above-identified patent and that said Letters Patent is hereby corrected as shown below:

Column 16,
Line 62, change "clearance along" to -- clearance space along --.

Signed and Sealed this

Twenty-ninth Day of January, 2002

*Attest:*

*Attesting Officer*

JAMES E. ROGAN
*Director of the United States Patent and Trademark Office*